US008408265B2

(12) United States Patent
Chang

(10) Patent No.: US 8,408,265 B2
(45) Date of Patent: Apr. 2, 2013

(54) TAPE DISPENSER

(76) Inventor: Chi-Tsai Chang, Taichung (TW)

( * ) Notice: Subject to any disclaimer, the term of this patent is extended or adjusted under 35 U.S.C. 154(b) by 0 days.

(21) Appl. No.: 13/240,038

(22) Filed: Sep. 22, 2011

(65) Prior Publication Data

US 2012/0006932 A1 Jan. 12, 2012

Related U.S. Application Data

(63) Continuation-in-part of application No. 12/684,959, filed on Jan. 10, 2010, now abandoned.

(51) Int. Cl.

| | |
|---|---|
| ***B29C 65/00*** | (2006.01) |
| ***B65H 18/28*** | (2006.01) |
| ***B65H 16/06*** | (2006.01) |
| ***B65H 75/12*** | (2006.01) |
| *B26F 3/02* | (2006.01) |

(52) U.S. Cl. ..... 156/510; 242/160.3; 242/170; 242/598; 242/614; 225/48; 225/77; 225/49; 225/39; 225/66; 225/47; 225/26; 225/42

(58) Field of Classification Search ..... 156/510; 225/42, 46, 48, 77, 49, 39, 66, 47, 26
See application file for complete search history.

(56) References Cited

U.S. PATENT DOCUMENTS

| | | | | |
|---|---|---|---|---|
| 3,417,935 | A * | 12/1968 | Douglas et al. | 242/588.4 |
| 3,972,459 | A | 8/1976 | Cooper | |
| 5,683,058 | A * | 11/1997 | Schwarz et al. | 242/578.2 |
| 5,735,400 | A * | 4/1998 | Packard | 206/408 |
| 6,386,416 | B1 * | 5/2002 | Dunshee et al. | 225/49 |

* cited by examiner

*Primary Examiner* — Philip Tucker
*Assistant Examiner* — Alex Efta
(74) *Attorney, Agent, or Firm* — Muncy, Geissler, Olds & Lowe, PLLC

(57) ABSTRACT

A tape dispenser of the present invention includes an integrally-formed main body. The main body has a rack and two semi-crusts. The semi-crusts are pivotably connected to the rack, so that the semi-crusts can be closed for a tape roll to be received therein. Or, the semi-crusts can be opened for placing or replacing the tape roll. The rack has a front plate and a top plate. The front plate, the top plate, and the semi-crusts are rectangularly arranged. Thus, structure strength of the tape dispenser is increased.

13 Claims, 7 Drawing Sheets

TAPE DISPENSER

The present invention is a Continuation-In-Part of application Ser. No. 12/684,959, filed Jan. 10, 2010 now abandoned, the entire contents of which are hereby incorporated by reference.

BACKGROUND OF THE INVENTION

1. Field of the Invention

2. Description of the Prior Art

Conventional tape dispenser, as disclosed in U.S. Pat. No. 3,972,459, is composed of a front piece and two side parts. The side parts are attached to the front piece respectively, and are able to be spread either side. Thus, tape roll can be installed in the tape dispenser easily. However, the tape roll is uncovered and exposed to the surroundings since the tape roll is not concealed by the tape dispenser. The tape would probably be contaminated before being used.

To protect the tape roll from the contamination, another tape dispenser is provided in U.S. Pat. No. 6,386,416. The tape dispenser has not only front piece and side parts, but also flanges and cover. After tape roll is installed in the tape dispenser, the tape is covered by the tape dispenser so as to block the contamination out. The tape roll can be kept clean before using.

However, the mentioned tape dispensers are both lack of structure strength. The tape dispensers are substantially made of a single sheet. Components of the tape dispensers are connected in a planar structure, and bent or folded with folding lines to accomplish the tape dispensers. The tape dispensers may be deformed even destroyed since the folding lines of the tape dispensers can be deformed or transformed easily.

In addition, the tape dispensers can not properly fit with tape rolls which have numerous widths respectively. In U.S. Pat. No. 6,386,416, Dunshee et al. provides nothing about fitness of the tape dispenser. In U.S. Pat. No. 3,972,459, Cooper's tape dispenser has a shaft provided with a conical appearance. However, the conical shaft can fit with only tape rolls which have numerous diameters, rather than tape rolls which have numerous widths. The tape roll which has a smaller width would waddle on the shaft. Thus, quality of the tape dispenser can hardly be increased.

The present invention is, therefore, arisen to obviate or at least mitigate the above mentioned disadvantages.

SUMMARY OF THE INVENTION

The main object of the present invention is to provide another tape dispenser which has a strengthened structure and is suitable for numerous kinds of tape rolls.

To achieve the above and other objects, a tape dispenser of the present invention includes an integrally-formed main body.

The main body has a rack and two semi-crusts. The rack has a front plate and a top plate which is nonparallel to the front plate. The semi-crusts are connected to the rack respectively by top edges thereof. The top edges of the semi-crusts are parallel to each other. The top edges of the semi-crusts, a bottom edge of the front plate, and a rear edge of the top plate are rectangularly arranged, defining an opening therebetween. The semi-crusts abut against each other so as to define a chamber therebetween. The chamber is adapter for a tape roll to be received therein. Each of the semi-crusts has a central post. The central posts engage detachably with each other. The central posts are adapted for the tape roll to sleeve thereon. Each of the central posts has at least one elastic abutting arm which extends from the corresponding semi-crust. Each of the abutting arms has a protrusion protruding radially from an appearance of the corresponding central post into the chamber, so that the protrusions are adapted for the tape roll to abut thereagainst. Each of the top edges of the semi-crusts is formed with a folding line. The semi-crusts are bendable and pivotable with respect to the rack The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
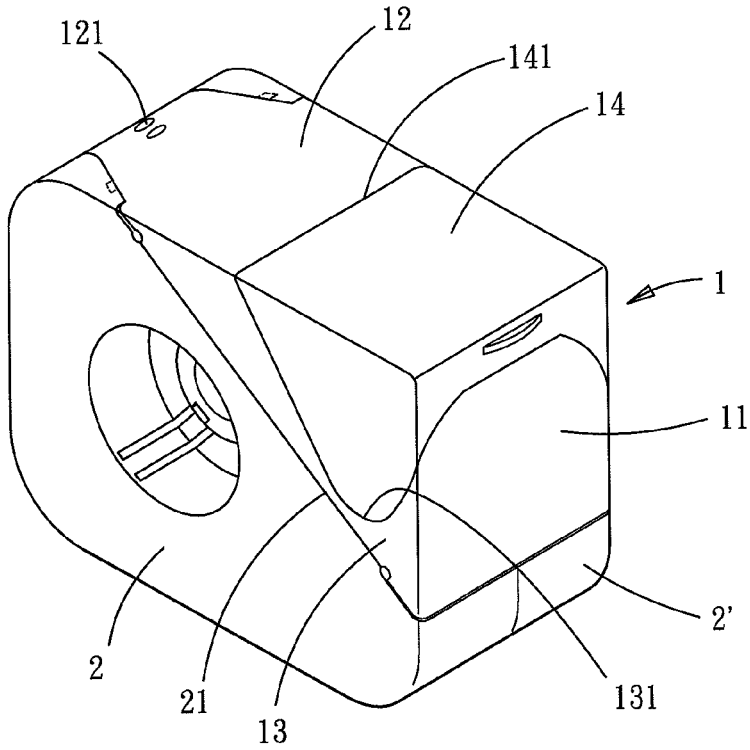
FIG. 1 is a stereogram showing a first embodiment of the present invention.
Figure 2:
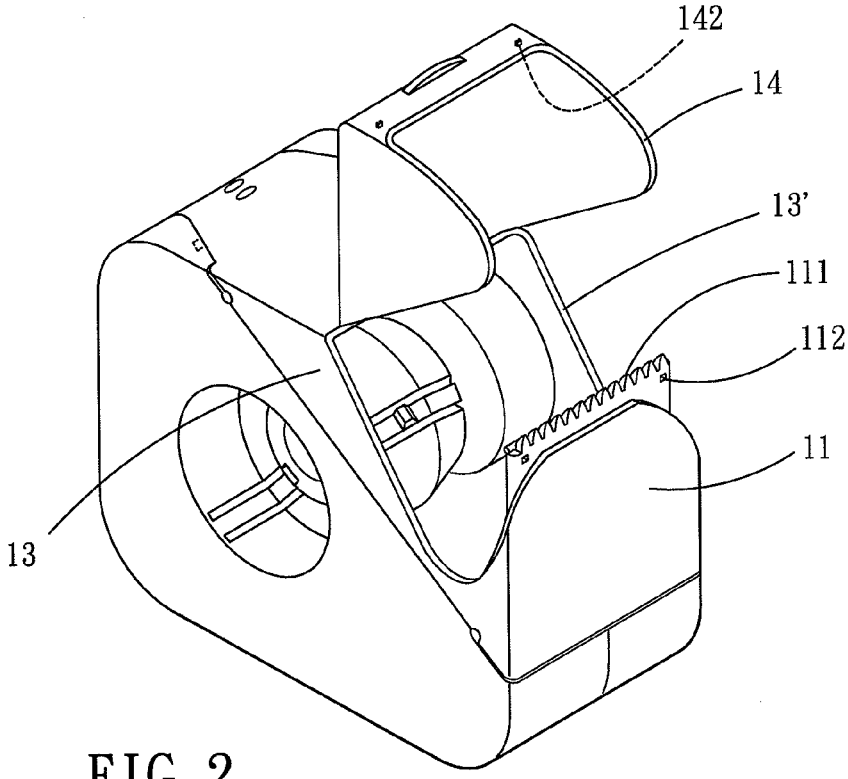
FIG. 2 is a stereogram showing a first embodiment of the present invention when the lid is opened.
Figure 3:
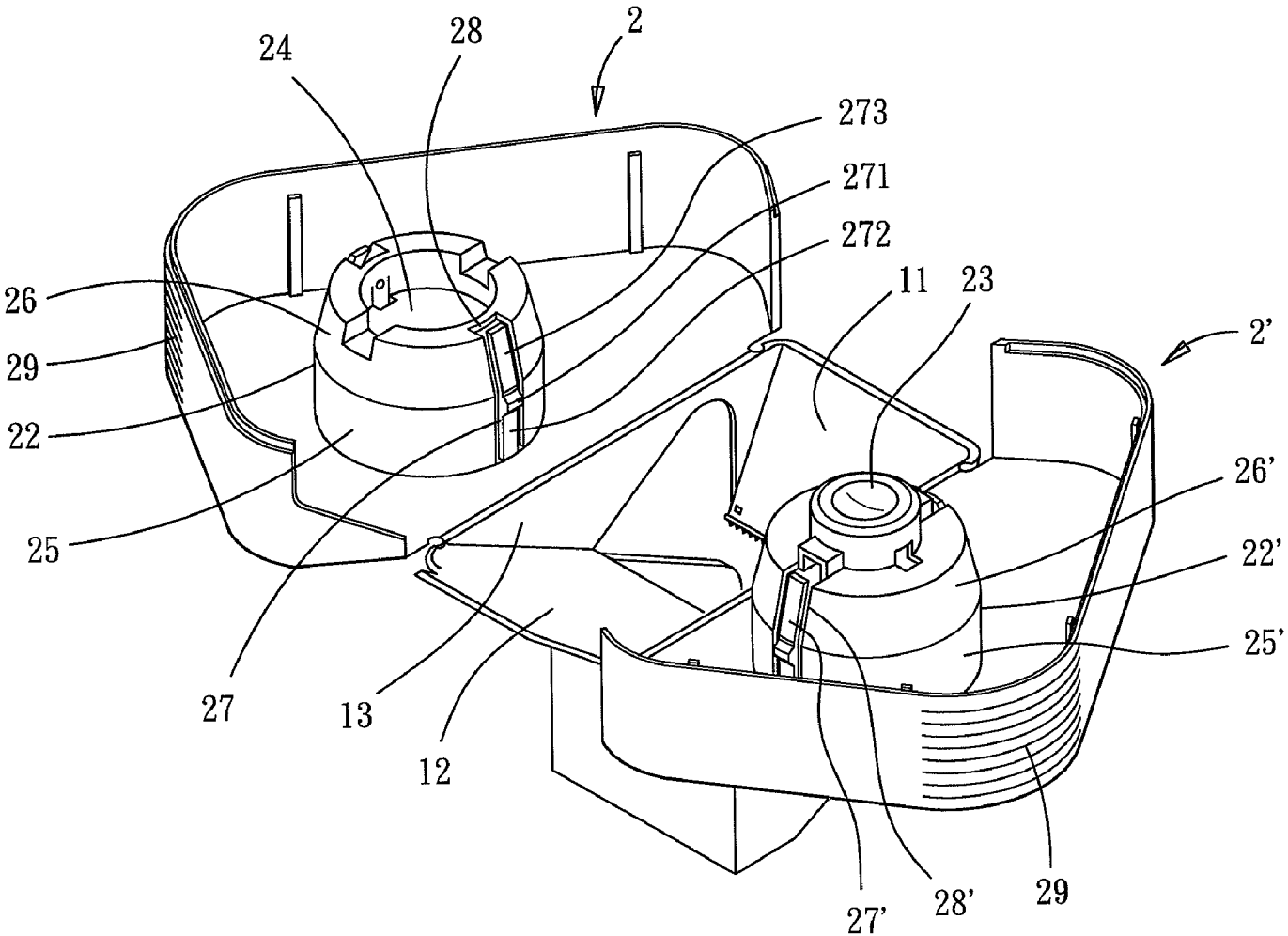
FIG. 3 is a stereogram showing a first embodiment of the present invention when the chamber is opened.
Figure 4:
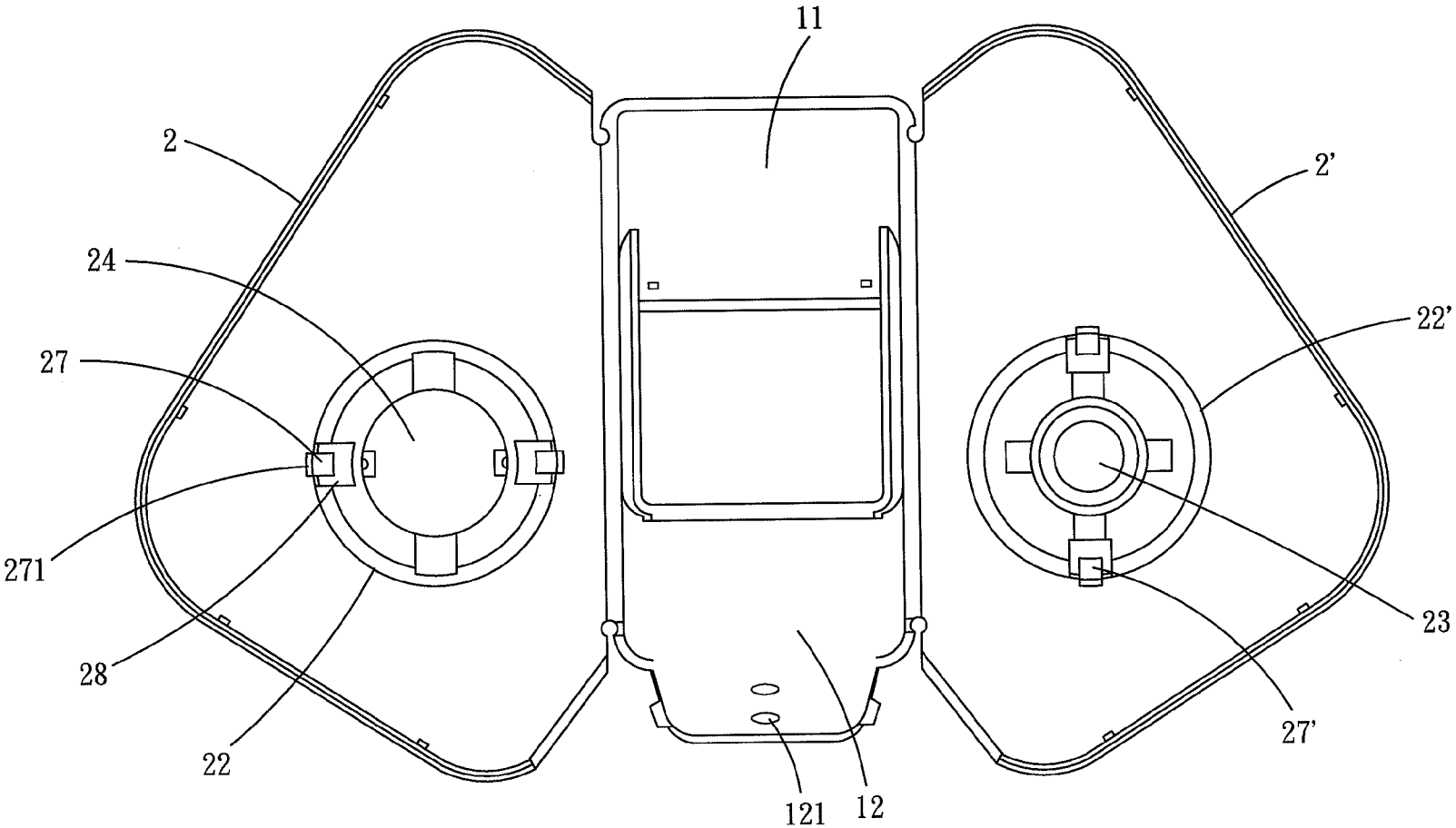
FIG. 4 is a planar drawing showing a first embodiment of the present invention when the chamber is opened.
Figure 5:
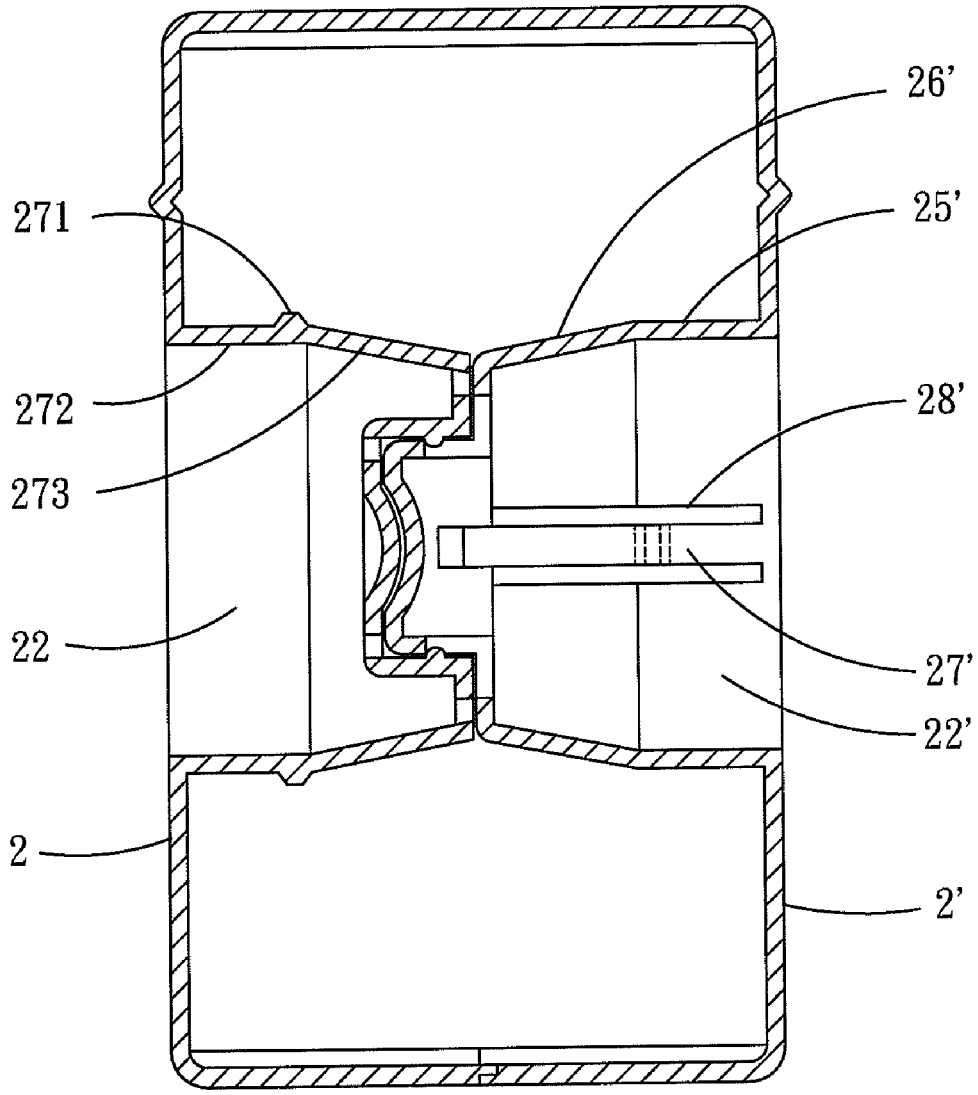
FIG. 5 is a profile showing a first embodiment of the present invention.

Please refer to FIG. 1 to FIG. 5 for a first embodiment of the present invention. The tape dispenser of the present embodiment includes an integrally-formed main body. In some possible embodiments of the present invention, an additional independent cutter may be included in. The main body has a rack 1 and two semi-crusts 2, 2'.

The rack 1 has a front plate 11, a top plate 12, two side plates 13, 13', and a lid 14. The front plate 11 is formed with a cutter 111 upwardly, or the independent cutter may be disposed on the front plate 11. The front plate 11 is further formed with two positioning grooves 112. The top plate 12 is formed with two hanging holes 121 which are adapted for string to thread with. In some possible embodiments of the present invention, one single hanging hole 121 may be able to perform the similar function. The top plate 12 is nonparallel to the front plate 11. More particular, the top plate 12 is perpendicular to the front plate 11. The side plates 13, 13' connect the front plate 11 to the top plate 12 respectively, so that the side plates 13, 13', the front plate 11, and the top plate 12 are rectangularly arranged. The side plates 13, 13' are parallel to each other, and perpendicular to both of the front plate 11 and the top plate 12. It is noted that rectangularly arrangement means that the components are arranged annularly and are perpendicular to the adjacent components. The whole appearance of the rack 1 is not necessary to be formed as a complete cuboid.

The lid 14 is connected to the top plate 12. The lid 14 is formed with a folding line 141, and the lid 14 is pivotable about the folding line 141 with respect to the top plate 12. Thus, user can bend and sway the lid 14. The lid 14 is formed with two buckles 142 which can be detachably engaged with the positioning grooves 112 of the front plate 11, so that the lid 14 is removably attached to the front plate 11. Further, the lid 14 has a suitable structure that the lid 14 would abut both of the side plates 13, 13' when the lid 14 is attached to the front plate 11. Thus, the lid 14 is able to conceal components, such as an opening or a tape roll, therebeneath. In the preferred embodiment, the lid 14 and the top plate 12 is made of plastic. The material here is capable of providing an elastic force, so that the lid 14 can be designed to have a tendency to move apart from the front plate 11. In general, the lid 14 may be attached to the front plate 11 by engagement of the positioning grooves 112 and the buckles 142. User can press the front plate 11 laterally before using, so that the buckles 142 would disengage with the positioning grooves 112. Subsequently, the lid 14 would move apart from the front plate 11 by the tendency thereof, so that the lid 14 is able to be opened automatically. In other possible embodiments of the present invention, the positions of the positioning grooves 112 and buckles 142 may be interchanged, or the quantities of the positioning grooves 112 and buckles 142 may be diminished to single one respectively or be dismissed.

The semi-crusts 2, 2' are connected to the rack 1 respectively by top edges thereof. More particularly, top edges of the semi-crusts 2, 2' are connected to the side plates 13, 13' respectively. Thus, the top edges are parallel to each other, and the top edges of the semi-crusts 2, 2', a bottom edge of the front plate 11, and a rear edge of the top plate 12 are rectangularly arranged. An opening is defined by edges of the side plates away from the semi-crusts, the bottom edge of the front plate, and the rear edge of the plate which are arranged rectangularly. Further, each of the top edges of the semi-crusts 2, 2' is formed with a folding line 21. Thus, the semi-crusts 2, 2' are bendable and pivotable with respect to the rack 1. Preferably, the semi-crusts 2, 2' are formed with flanges 29 which are located away from the top edges thereof. The flanges 29 are provided for user to pull the semi-crusts 2, 2'.

The semi-crusts 2, 2' abut against each other, so that a chamber is defined between the semi-crusts 2, 2'. Preferably, the chamber is enclosed by the semi-crusts 2, 2' and the opening. The chamber is adapted for a tape roll to be received therein.

Each of the semi-crusts 2, 2' has a central post 22, 22'. The central posts 22, 22' engage detachably with each other. More particularly, one of the central posts 22' is formed with an engagement portion 23, and the other one is formed with an engagement recess 24 which is fit with the engagement portion 23. The central posts 22, 22' are adapted for the tape roll to sleeve thereon. Preferably, each of the central posts 22, 22' has a bottom portion 25, 25' and a top portion 26, 26'. The bottom portion 25 extends from the corresponding semi-crust 2. The top portion 26 extends from the corresponding bottom portion 25. Similar structure is formed on the other central posts 22'. The two top portions 26, 26' are formed frustoconically which aim at each other.

Each of the central posts 22, 22' has two, or at least one elastic abutting arm 27, 27'. The abutting arms 27, 27' extend from the corresponding semi-crusts 2, 2'. Each of the abutting arms 27, 27' has a protrusion 271 protruding radially from the appearance of the corresponding central post 22 into the chamber at an intermediate section of the abutting arm 27, 27'. More particularly, each of the central posts 22, 22' has grooves 28, 28' corresponding to the abutting arms 27, 27'. The abutting arms 27, 27' are located in the grooves 28, 28', and the protrusions 271 protrude into the chamber surrounding the central posts. Thus, the protrusions 271 would abut against the tape roll along a radial direction of the tape roll when the tape roll is received in the chamber. In the preferred embodiment of the present invention, each of the abutting arms has a bottom section 272 and a top section 273. The top section 273 extends slantly from the bottom section 272. More specifically, the bottom section 272 and the top section 273 extend following with the bottom portion 25 and the top portion 26. The protrusions 271 of the abutting arms are located on the corresponding bottom section 272 and adjoined the top section 273. All the abutting arms 27, 27' of the two central posts are circularly and equidistantly arranged. Preferably, the abutting arms 27 of one of the central posts are arranged staggered with the abutting arms 27' of the other one of the central posts. In other words, any two adjacent abutting arms 27, 27' belong to the two central posts 22, 22' respectively.

Accordingly, structure strength of the tape dispenser of the present invention is improved. Stereo structure of the tape dispenser is not only being composed of several folding lines but including a rack 1. Especially, the strengthened front plate 11 which is not parallel to the top plate 12 is included in and is formed to support the cutter thereon. Further, the components of the rack 1 and the semi-crusts 2, 2' are rectangularly arranged. The structure strength can be increased with limited components and material.

Figure 6:
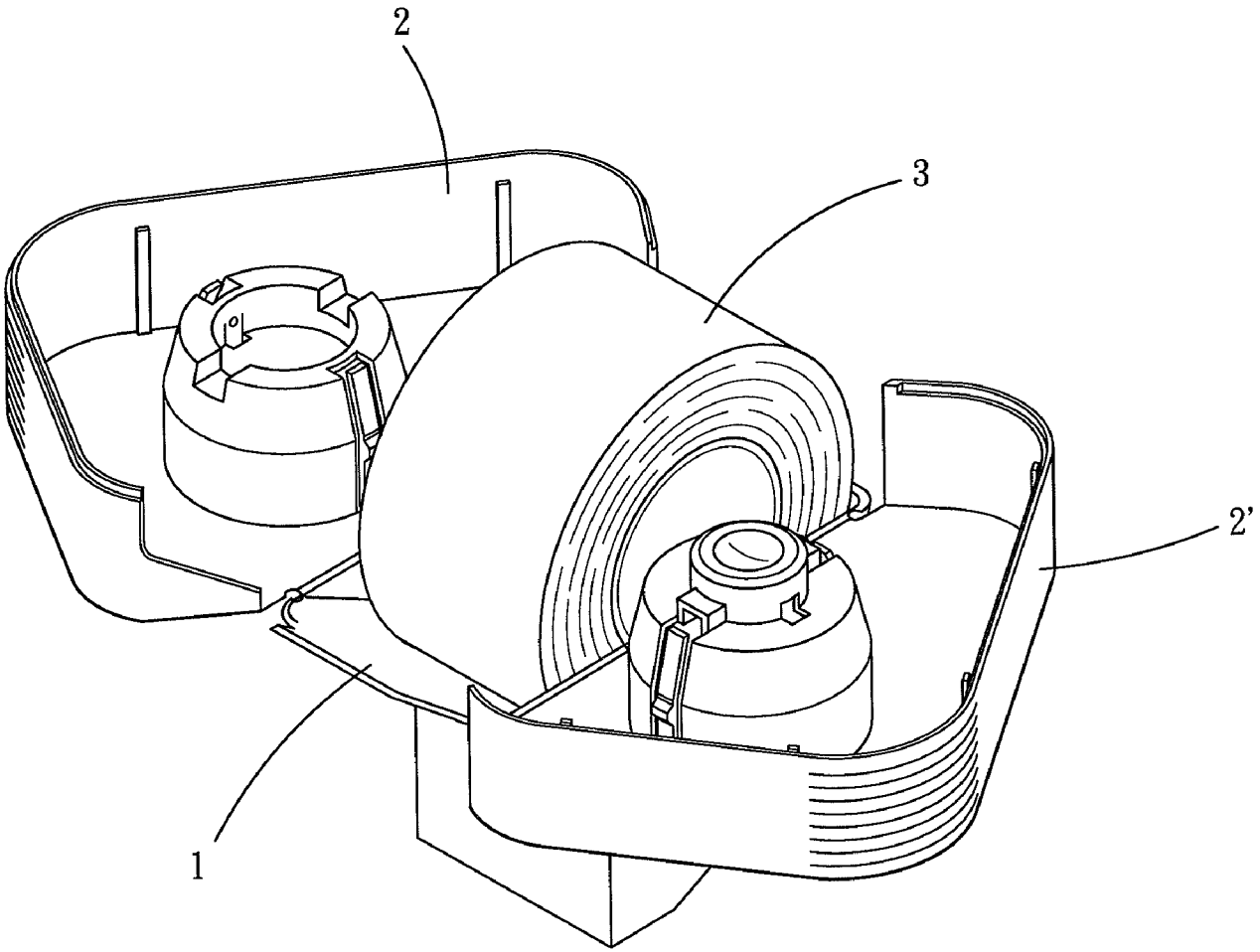
FIG. 6 is a combination drawing showing a first embodiment of the present invention.

On the other hand, the tape dispenser provides another operation form with the rack 1. Please refer to FIG. 3 and FIG. 6. When user installs a tape roll 3 into the tape dispenser, the semi-crusts 2, 2' are spread and the tape dispenser is opened firstly. The tape dispenser is turned upside-down. The tape roll 3 is then placed on the rack 1. User should only close the semi-crusts 2, 2', and the installation is complete. In comparison with conventional tape dispenser, whose tape roll should be aligned to the central post, the tape dispenser of the present invention is advanced in operational properties.

Figure 7:
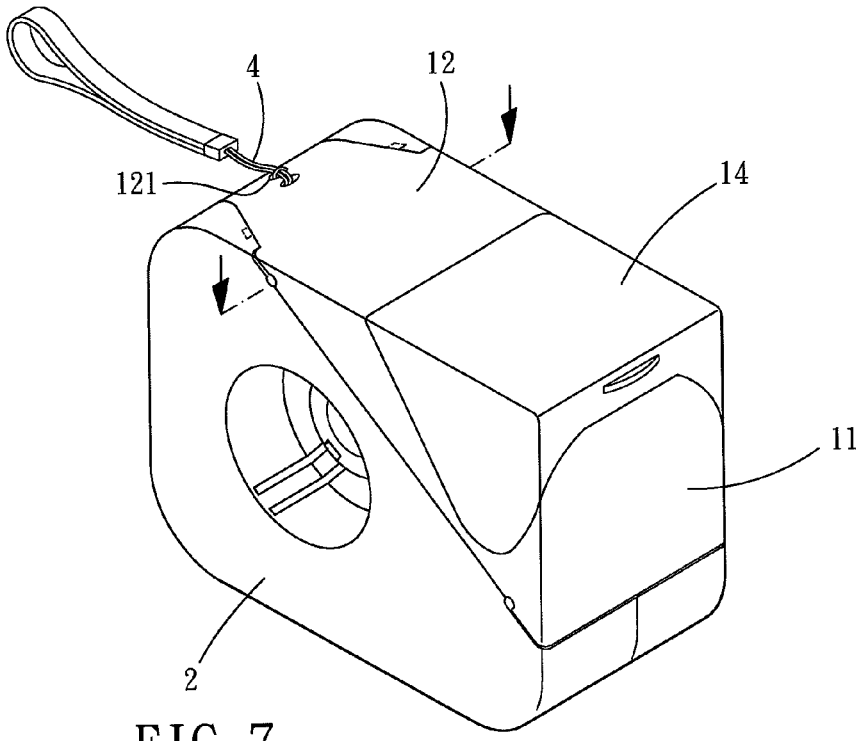
FIG. 7 is a stereogram showing a store condition of a first embodiment of the present invention.
Figure 8:
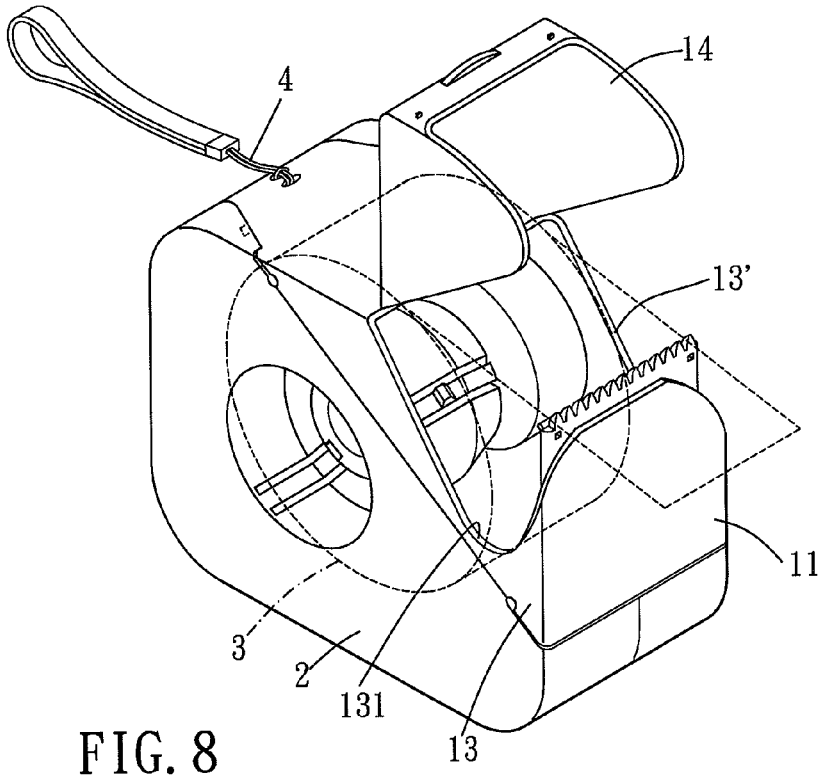
FIG. 8 is a stereogram showing a using condition of a first embodiment of the present invention.

Please refer to FIG. 7. The hanging holes 121 of the top plate 12 are provided for string 4 to penetrate therethrough, so that the tape dispenser can be suspended. When user wants to get the tape from the tape roll 3 installed in the tape dispenser, user can press the front plate 11 firstly. The lid 14 is then opened automatically by the elastic force or the tendency thereof, as shown in FIG. 8. Thus, user can get the tape easily. Preferably, the side plates 13, 13' may be formed with a recess 131 which is sized for finger to pass through.

Figure 10:
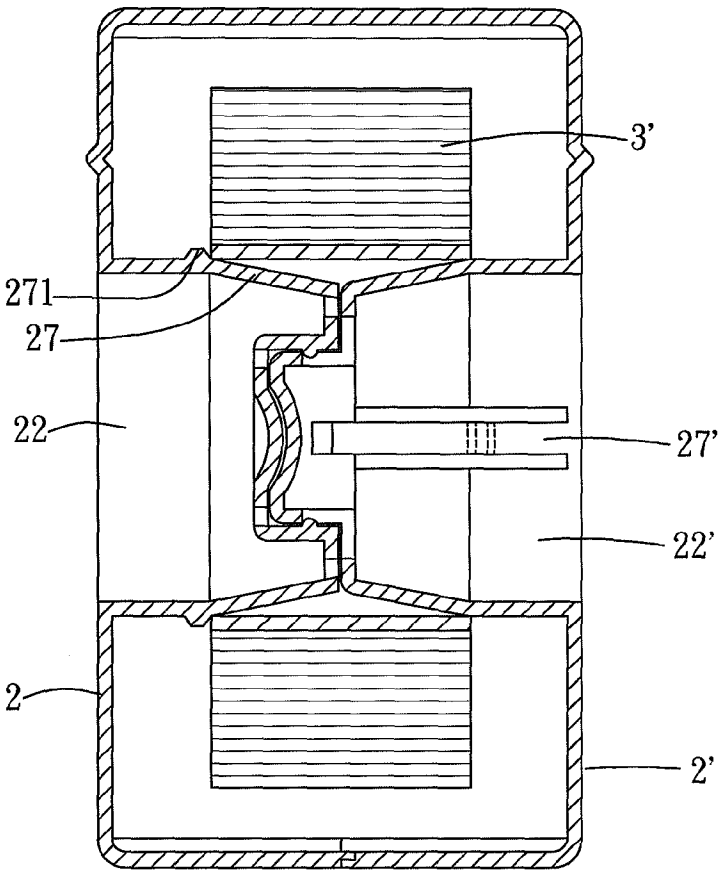
FIG. 10 is a profile showing a combination condition of smaller tape roll and a first embodiment of the present invention in comparison with FIG. 8.
Figure 9:
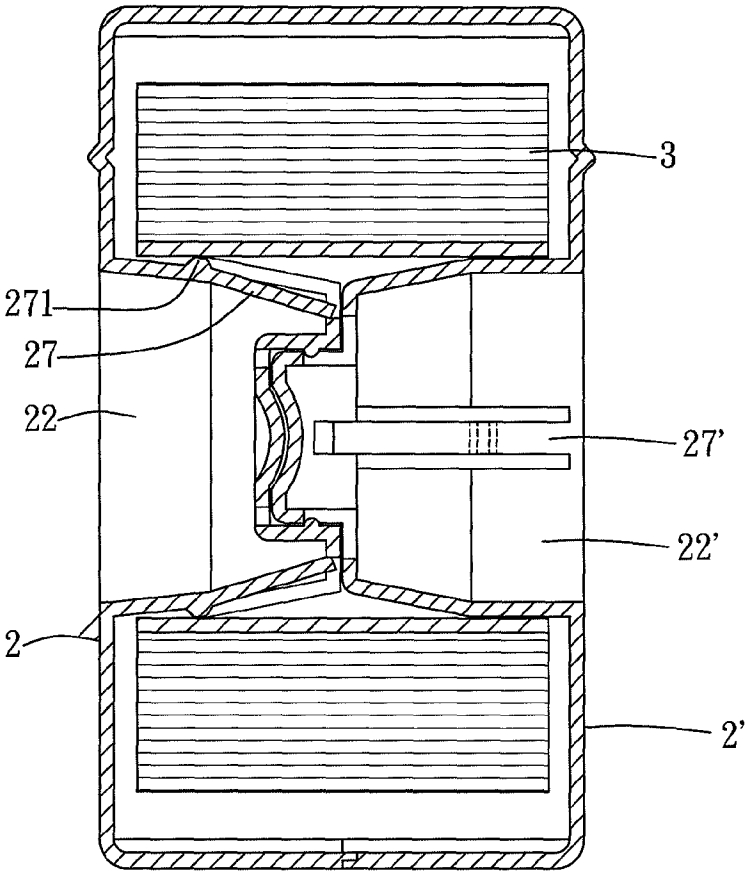
FIG. 9 is a profile of FIG. 6.

In addition, the tape dispenser of the present invention is able to fit with tape rolls which have numerous widths. Please refer to FIG. 9. The tape roll 3 installed in the tape dispenser abuts against the abutting arms 27, 27' and the protrusions 271. Thus, the tape roll 3 would not waddle on the central posts 22, 22' even though the tape roll 3 does not abut the semi-crusts 2, 2' directly. Please refer to FIG. 10. When another tape roll 3' which is installed in has a smaller width, the protrusions 271 are still able to keep the tape roll 3' in middle of the chamber. Thus, the tape dispenser is suitable for numerous kinds of tape rolls.

What is claimed is:

1. A tape dispenser, comprising:

an integrally-formed main body, having a rack and two semi-crusts, the rack having a front plate and a top plate which is nonparallel to the front plate, the rack further having two side plates which connect the front plate to the top plate respectively, the sides plates, the front plate, the top plate are rectangularly arranged, the semi-crusts being connected to the rack respectively by top edges thereof, the top edges of the semi-crusts being parallel to each other, edges of the side plates away from the semi-crusts, a bottom edge of the front plate, and a rear edge of the top plate being rectangularly arranged and defining an opening therebetween, the semi-crusts abutting against each other so as to define a chamber therebetween, the chamber being adapted for a tape roll to be received therein, each of the semi-crusts having a central post, the central posts engaging detachably with each other, the central posts being adapted for the tape roll to sleeve thereon, each of the central posts having at least one elastic abutting arm which extends from the corresponding semi-crust, each of the abutting arms having a protrusion at an intermediate section of the abutting arm protruding radially from an appearance of the corresponding central post into the chamber, so that the protrusions are adapted for the tape roll to abut thereagainst along a radial direction of the tape roll, each of the top edges of the semi-crusts being formed with a folding line, the semi-crusts being bendable and pivotable with respect to the rack.

2. The tape dispenser of claim 1, wherein the chamber is enclosed by the opening and the semi-crusts.

3. The tape dispenser of claim 1, wherein each of the central posts has at least one groove, and the abutting arms are located in the grooves.

4. The tape dispenser of claim 1, wherein each of the central posts has plural abutting arms, and all the abutting arms of the posts are circularly and equidistantly arranged.

5. The tape dispenser of claim 4, wherein the abutting arms of one of the central posts are arranged staggered with the abutting arms of the other one of the central posts.

6. The tape dispenser of claim 3, wherein each of the central posts has plural abutting arms, and all the abutting arms of the posts are circularly and equidistantly arranged.

7. The tape dispenser of claim 6, wherein the abutting arms of one of the central posts are arranged staggered with the abutting arms of the other one of the central posts.

8. The tape dispenser of claim 1, wherein each of the central posts has a bottom portion extending from the corresponding semi-crust and a top portion extending from the corresponding bottom portion, each of the top portions is formed frustoconically aiming at the other top portion, each of the abutting arms has a bottom section and a top section slantly extending from the bottom section, and the protrusions are located on the bottom sections and adjoined the top sections.

9. The tape dispenser of claim 1, wherein each of the side plates is perpendicular to both of the top plate and the front plate, and the top plate is perpendicular to the front plate.

10. The tape dispenser of claim 1, wherein the rack has a lid, the lid is connected to the top plate, the lid is formed with another folding line, and the lid is pivotable about the folding line with respect to the top plate, so that the opening is selectively concealed by the lid.

11. The tape dispenser of claim 10, wherein one of the front plate and the lid is formed with a positioning groove, the other one is formed with a buckle, the buckle is detachably engaged with the positioning groove, and the lid is removably attached to the front plate.

12. The tape dispenser of claim 1, wherein the top plate is formed with at least one hanging hole with which is adapted for string to thread.

13. The tape dispenser of claim 1, wherein each of the semi-crusts is formed with plural flanges which are located away from the top edges thereof.

* * * * *